US010065844B2

(12) United States Patent
Buchik

(10) Patent No.: US 10,065,844 B2
(45) Date of Patent: Sep. 4, 2018

(54) DEVICE FOR MANUALLY POURING FOAMING AND CARBONATED BEVERAGES

(71) Applicant: Sergei Aleksandrovich Buchik, g. Novosibirsk (RU)

(72) Inventor: Sergei Aleksandrovich Buchik, g. Novosibirsk (RU)

( * ) Notice: Subject to any disclaimer, the term of this patent is extended or adjusted under 35 U.S.C. 154(b) by 101 days.

(21) Appl. No.: 15/123,388

(22) PCT Filed: Apr. 10, 2014

(86) PCT No.: PCT/RU2014/000263
§ 371 (c)(1),
(2) Date: Mar. 23, 2017

(87) PCT Pub. No.: WO2015/156697
PCT Pub. Date: Oct. 15, 2015

(65) Prior Publication Data
US 2017/0203945 A1 Jul. 20, 2017

(51) Int. Cl.
*B67C 3/28* (2006.01)
*B67C 3/06* (2006.01)
*B67C 3/24* (2006.01)

(52) U.S. Cl.
CPC ..... *B67C 3/28* (2013.01); *B67C 3/06* (2013.01); *B67C 3/242* (2013.01)

(58) Field of Classification Search
CPC ..... B67C 3/28; B67C 33/06; B67C 3/242; B67D 1/04
See application file for complete search history.

(56) References Cited

U.S. PATENT DOCUMENTS

| | | | | |
|---|---|---|---|---|
| 3,460,589 | A | 9/1966 | Justis | |
| 3,604,480 | A * | 9/1971 | Reichert et al. | B67C 3/06 141/39 |
| 4,676,400 | A | 6/1987 | Lamont et al. | |
| 6,164,083 | A | 12/2000 | Leeming et al. | |

FOREIGN PATENT DOCUMENTS

| | | |
|---|---|---|
| RU | 2 226 862 C2 | 12/2005 |
| RU | 2 337 053 C2 | 10/2008 |
| RU | 2 381 174 C1 | 2/2010 |
| RU | 126 694 U1 | 4/2013 |
| WO | 00/58201 | 10/2000 |

OTHER PUBLICATIONS

English Abstract of RU2337053C2.
English Abstract of RU2381174C1.
English Abstract of RU2266862C2.

* cited by examiner

*Primary Examiner* — Timothy L Maust
*Assistant Examiner* — Timothy P Kelly
(74) *Attorney, Agent, or Firm* — Ladas & Parry LLP

(57) ABSTRACT

The invention relates to the food industry, and specifically to commercial equipment, and can be used for dispensing beer and other foaming and carbonated beverages from an isobaric container. The device includes a drainage channel which is connected by means of a three-way flow switch to tubes for feeding gas and beverage, a unit for securing the neck of a plastic bottle to the open end of the drainage channel and a control valve which is connected to the drainage channel.

18 Claims, 4 Drawing Sheets

E-E

DEVICE FOR MANUALLY POURING FOAMING AND CARBONATED BEVERAGES

RELATED APPLICATION

Figure 1:
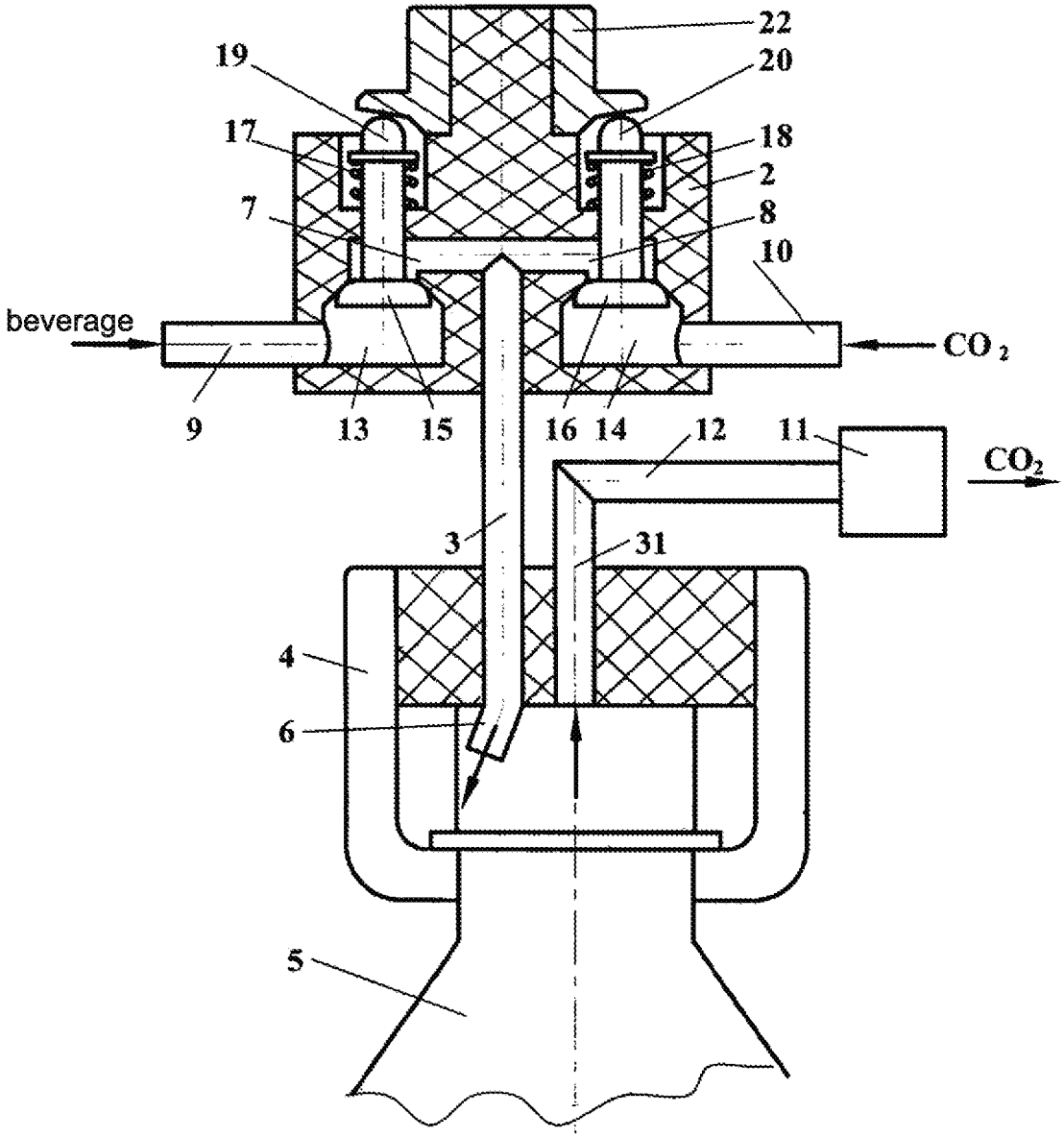

This application is a national phase entry under 35 USC 371 of International Patent Application No.: PCT/RU2014//000263 filed on 10 Apr. 2014, the disclosure of which is incorporated in its entirety by reference herein.

The invention relates to the food industry, more particularly, to commercial equipment, and is useful for dispensing beer and other foaming and carbonated beverages from an isobaric container both to the small containers (mugs, glasses) and to the plastic bottles in the retail distribution stands, stores, restaurants and bars.

A beer dispensing device is known from U.S. Pat. No. 6,164,083, IPC 67 D 1/08, published on 26 Dec. 2000, comprising an isobaric container with beer, or several such containers with various beer brands, a cooling system and dispensing unit, which is equipped with a pipework with dispense taps for pouring beverage into the small containers, and a tube for beer delivery into dispensing unit, which is shaped as a closed circuit and provided with a pump for circulating beverage within the circuit and with a cooling unit.

There is another known device for manually pouring foaming and/or carbonated beverages which includes: gas bottle, beverage keg, cooler, a counter with a tap for pouring beverage into small containers, and a form suppression unit for suppressing foam during pouring beverage, installed in a spill pipe of the tap, all series-connected by tubes (see WO 00/58201, IPC B 67 D 1/14, published on 5 Oct. 2000).

However, the above mentioned devices allow dispensing beverages only into small containers (mugs, glasses), they do not enable filling plastic bottles from isobaric containers with counterpressure method.

Another piece of prior art is a device for manually dispensing of foaming and/or carbonated beverages which includes beverage preparation system for dispensing with a gas bottle and an isobaric container for beverage, and beverage pouring mechanism with a foam suppression unit (see RU Patent No. 2266862, IPC B 67 C 3/02, published on 27 Dec. 2005). Beverage pouring mechanism comprises a housing with a drainage channel connected with a beverage supply tube from an isobaric container, a unit for securing a plastic bottle neck to the open end of the drainage channel, located at the housing near the drainage channel, and a throttle valve installed in the housing and connected to the drainage channel, and a foam suppression unit is located in the drainage channel. Channels connected to the gas and beverage supply tubes are connected by an additional channel to the drainage channel through a three-way valve, mounted on the housing of the mechanism for dispensing beverage into plastic bottles. Beverage pouring mechanism is equipped with a valve for pouring beverage into mugs or glasses, connected to beverage supply tube from isobaric container. Three-way valve comprises a cylindrical housing with a lid, in the bottom of which two through inlet openings and one outlet opening are provided, as well as rotatable upper disk which is coaxially settled inside the body, and immobile lower disk. The upper disk is rigidly linked through the hole in the lid with a handle, located outside the three-way valve housing; and there are through openings in the lower disk, which are coaxially aligned with the openings in the bottom of a housing. In the upper disk body, from the lower disk side, in front of its openings there is a non-through crescent-shaped groove for connecting one of the inlet openings of the housing to its outlet opening. An O-ring is placed around the handle underneath the housing lid for pressing upper and lower disks to each other and to the bottom of a housing; resilient O-rings are placed also in the housing bottom openings. A unit for securing plastic bottle neck to the open end of the drainage channel comprises an annular elastic element attached to the open end of the drainage channel coaxial to its outlet opening, and a cup with a handle and a socket matching the size of the plastic bottle neck; and besides, cylindrical portion of the cup is located around the open end of the drainage channel nearby the outlet opening and kinematically connected with the drainage channel wall by means of bayonet joint, and socket of the cup is located in front of the outlet opening of the drainage channel. A bayonet joint comprises a non-through helical groove in the drainage channel wall, with an axle with a roller installed in it, attached to the cylindrical portion of the cup of the plastic bottle neck securing unit. The above unit allows for fast end hermetical securing the plastic bottle neck to the drainage channel open end of the device for manually pouring foaming and/or carbonated beverages. A foam suppression unit of the beverage pouring mechanism comprises a tap with an axial passage with an outer cylindrical portion with a spiral groove on the lateral surface, and a shank, forming an annual cavity between its outer surface and the surface of the drainage channel. Foam suppression is ensured by setting gas pressure in the beverage pouring system and above the beverage face in the plastic bottle, which is greater than the saturation pressure of the gas dissolved in the beverage, which does not allow the liquid to boil up. Due to centrifugal forces the foam suppression unit ensures delivery of the beverage in form of a film on the wall of a plastic bottle, which reduces the fluid flow turbulence.

The disadvantage of such device is the low reliability of the three way disk cartridge valve of the beverage pouring mechanism and complexity of its technological maintenance associated with rinsing the disks and seals after finishing dispensing the beer or any other beverage.

There is a known device for manually dispensing foaming and carbonated beverages (Utility Model Patent No. 126694, IPC B67C3/00, published on 10 Apr. 2013), comprising a beverage preparation system for pouring with a gas bottle and isobaric container for beverage, and beverage dispensing mechanism with a foam suppression unit, including a housing, fluid and gas supply channels, an additional channel connecting fluid and gas supply channels, drainage channel, unit for dispensing beverage into plastic bottles with a bottle neck securing unit. Beverage dispensing mechanism contains two identical disk valves for communicating the channels with a beverage supply tube and a gas supply tube respectively; further, each one of the disk valves comprises a housing and a stem with slots; a mobile disk shutter is fixed in the stem slots, and an immobile disk shutter is placed in the housing slots; the disk shutters comprise crescent-shaped openings, and plates of the shutters are ground-in and tightly pressed to each other with O-rings.

The main drawback of this device is inconvenience of its operation, since gas and beverage supply valves, throttle valve and bottle neck securing unit have separate control handles (at least four handles), which complicates the operating personnel work.

The closest analogue (prototype) of the invention is a device for manually dispensing foaming and/or carbonated beverages (RU Patent No. 2337053, IPC B67C3/10, published on 10 May 2008), comprising: a housing with a channel connected with a gas supply tube from a gas bottle;

a channel connected with a beverage supply tube from isobaric container, a drainage channel connected by means of an additional channel with the channels connected to gas and beverage supply channels; a unit for securing plastic bottle neck to the open end of the drainage channel, located on the housing near the drainage channel; a throttle valve installed in the housing and connected with the drainage channel; and a foam suppression unit located in the drainage channel. Channels connected to gas and beverage supply tubes are provided with valves installed inside them, the stems of which are kinematically connected with a shaped cam installed in a cavity inside the housing of the beverage pouring mechanism on a shaft, one end of which comes through a sealed opening in the housing wall and rigidly connected with the control handle. Cam profile is shaped in such a way that it allows for alternative opening of the valves or sustaining them in closed position.

The drawback of the closest analogue is a low durability and reliability of design of the beverage dispensing device. The device described above has rather large contact area of the mobile elements of the flow switching mechanism with a beverage being dispensed (i.e. all surfaces of the valves and the rotatable cam), that reduces their durability and leads to accelerated deterioration of the "shaped cam—valve" friction pair, and, as a result, to ingress of wear debris into the dispensed beverage. In addition, it is known that on the surface of the equipment manufactured from metal and used for production, storing and bottling of beer, the so called beer scale is formed, that undesirably affects both quality of the beer and technical performance of the equipment. Certain alien, not typical for beer bacteria develop in the beer scale accumulated on surface of equipment in case of its prolonged non-removal, that negatively affects taste and color qualities of the beer. As for the equipment itself, the equipment with the beer scale deposited and formed on the surface thereof, becomes less robust and durable (http://www.beermarket.net.ua/forum/viewtopic.php?t=280).

Technical result of the present invention is an increase of durability, operational reliability and maintainability of the flow switch of the device for manually dispensing of beverages.

The specified technical result is achieved with an apparatus for manually dispensing of foaming and carbonated beverages comprising a drainage channel which is connected by means of a three-way flow switch to gas and beverage supply tubes, a unit for securing the neck of a plastic bottle to the open end of the drainage channel, located around the latter, and a control valve which is connected to the drainage channel, wherein three-way flow switch contains axially-symmetric cavities with seats, and, installed in the seats, spring-loaded valves, the stems of which are kinematically connected to a shaped surface (21) of a rotary element, which is rigidly connected to a control handle for the alternately opening of the valves or for sustaining said valves in their initial closed state; and the axially-symmetric cavities with seats are connected by means of inner channels to the drainage channel and to the gas and beverage supply tubes, according to the present invention, the three-way flow switch is installed in the housing of the apparatus and can be removed therefrom; the axially-symmetric cavities with seats for accommodating the blocking components of the valves are positioned in the inner channels of the flow switch, transversely relative to said inner channels; portions of the stems of the valves with springs are positioned outside the cavities of the inner channels of the flow switch. The valves with stems and the rotary element which comes into contact with the stems are made of thermoplastic material with an allowable compressive stress [σ] of 55-100 MPa, and a surface of the stems of the valves which comes into contact with the shaped surface of the rotary element is made extended as a portion of a second-order curve. Surface of the stems of the valves contacting with the shaped surface of the rotary element is developed in the form of a portion of spherical, elliptical or parabolic surface.

Rotary element is arranged in the form of a ring located around its rotation axis, and its shaped surface is located on the side of the rotary element, which is in contact with stems of the valves. Rotary element and stems of the valves are manufactured of polyamide or polyacetal. Rotary element with shaped surface includes a rotary element reset mechanism, also designed for bringing the valves to the closed state, made, for example, in the form of a torsion spring, the ends of which are fixed respectively on the rotary element and on the rotary element pivot axle. Rotary element with a shaped surface is provided with a lock for fixing it in positions: in initial position; with opened gas supply valve; with opened beverage supply valve. Rotary element position lock is arranged in the form of a spring-loaded element positioned in the housing of the flow switch, with possibility of being positioned in one of the three slots arranged on the pivot axle or on the shaped surface of the rotary element.

Increase of operational reliability of the three-way flow switch of the apparatus for manually dispensing of beverages consists in reduction of the contact surface of its mobile elements with the beverage, which results in reduction of beer scale formation on surfaces of the device, increase of its durability and reduction of its wear, as well as excludes ingress of wear debris into the dispensed beverage.

Contact surface of the valve in the form of the extended second order surface can be described by the expression $R=\sqrt{x^2+y^2+z^2}$.Use of extended surface results in contact stress reduction in rotary element/shaped surface friction pair and in the portions of the valve stems contacting with the surface. This increases the service life of the mechanism and makes it possible to use in its construction thermoplastic materials with a compressive stress [σ] of 55-100 parasitic MPa that have advantages in terms of weight and cost.

Designing surface of upper portions of stems in the form of a second order curve makes provides for minimization of a pressure angle in rotary element/stem friction pair. Minimal pressure angle, in conjunction with usage of thermoplastic materials which possess high antifriction properties (for example, polyamide or polyacetal resin), allows to reduce friction coefficient in the shaped rotary element/stem pair and to reduce parasitic loads on the stem.

Demountable fixing of the flow switch allows for its fast changing and repairing. The combination of the aforecited essential features allows for high reliability and maintainability of the apparatus, as well as manufacturability of its components.

Figure 2:
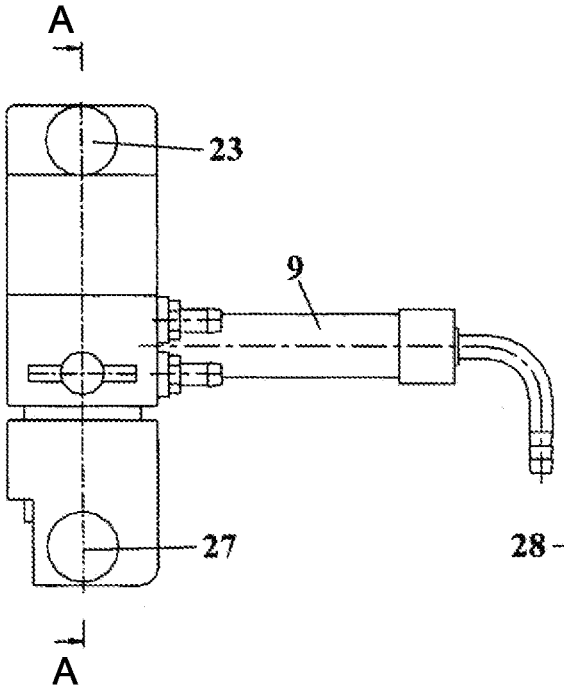
Figure 3:
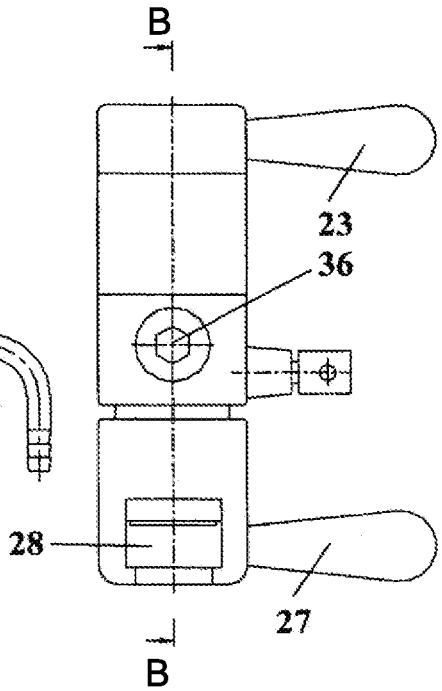
Figure 4:
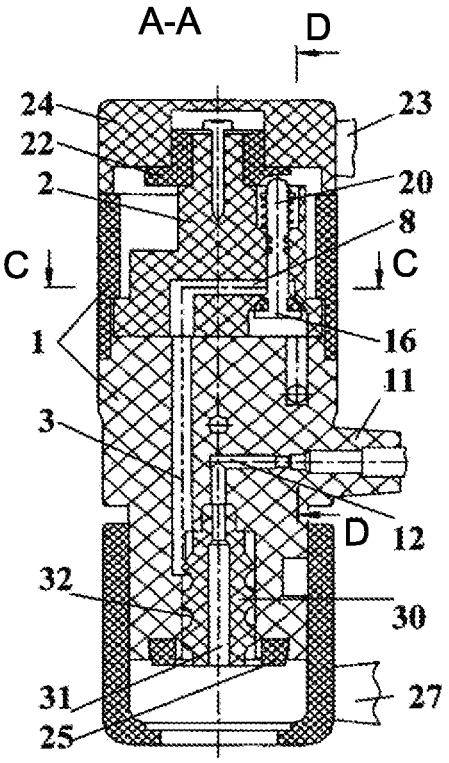
Figure 5:
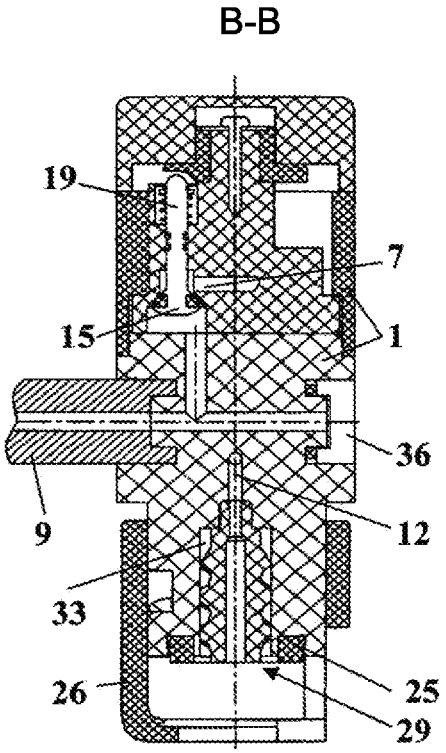
Figure 6:
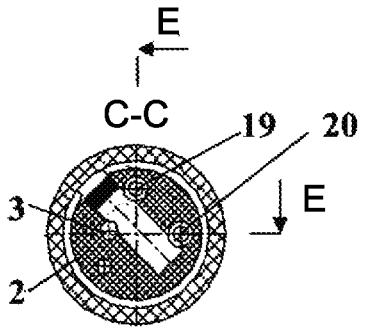
Figure 7:
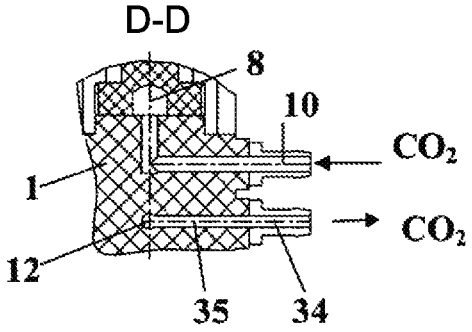
Figure 8:
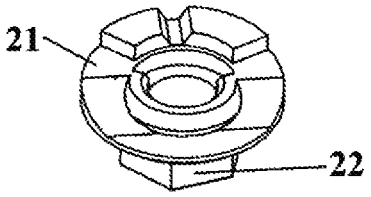
Figure 9:
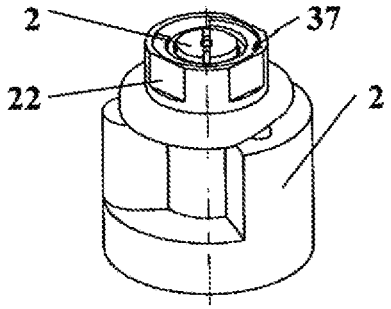
Figure 10:
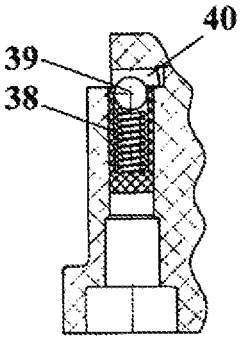
Figure 11:
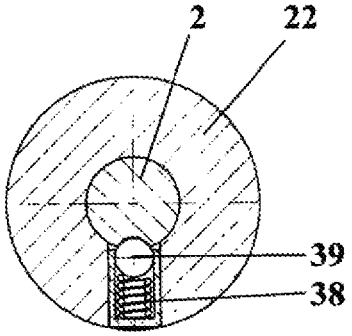
Figure 12:
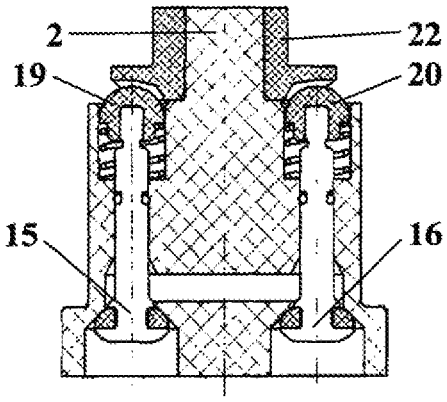

The invention is illustrated with the following graphic materials. FIG. 1 represents a scheme of device for manually dispensing of foaming and carbonated beverages into PET bottle. FIGS. 2 and 3 represent side and front views of the device respectively. FIG. 4 represents section of the device by A-A plane on FIG. 2. FIG. 5 represents section of the device by Б-Б plane on FIG. 3. FIGS. 6 and 7 demonstrate correspondingly sections B-B and Г-Г on FIG. 4. FIG. 8 represents appearance of the rotary element with a shaped surface. FIG. 9 represents appearance of the flow switch with rotary element reset mechanism made, for example, in the form of a torsion spring. FIG. 10 represents a rotary element lock located in the housing of the flow switch with slots on the rotary element shaped surface. FIG. 11 represents a rotary element lock located in the housing of the flow switch with slots on the rotary element pivot axle. FIG. 12 represents flow switch section view by plane Д-Д of FIG. 6.

Device for manually dispensing of foaming and carbonated beverages (FIGS. 1-5) comprises an aggregate housing 1 with a three-way flow switch 2, drainage channel 3 and a unit 4 for securing plastic bottle 5 neck to the open end 6 of the drainage channel 3, located around channel 3. Drainage channel 3 is connected to beverage supply fitting 9 and gas supply fitting 10 by means of intermediate channels 7 and 8 arranged in the flow switch 2. Control valve 11 is installed in the housing 1 and is connected by channel 12 to the container 5 cavity. Three-way flow switch 2 is located inside housing 1, with the possibility of its removal from the housing 1, and is fixed to the housing 1 with a screw connection.

Intermediate channels 7 and 8 of the flow switch 2 comprise axially-symmetric cavities 13 and 14 with seats and valves 15 and 16 installed in the seats with the return springs 17 and 18. Stems 19 and 20 of the valves 15 and 16 are kinematically connected to the shaped surface 21 of the rotary element 22. The rotary element 22 is rigidly connected to a control handle 23 for alternative opening of said valves 15, 16 or for sustaining valves 15, 16 in the initial closed state. The axially-symmetric cavities 13, 14 with seats for accommodating blocking components of the valves 15, 16 are positioned in the intermediate channels 7, 8 of the flow switching mechanism 2, transversely relative to the channels 7, 8. Portions of the stems (19, 20) of the valves (15, 16) with springs (17, 18) and the rotary element (22) are positioned outside the cavities of the inner channels (7, 8) of the flow switch (2). Valves (15, 16) with stems (19, 20) and rotary element (22) in contact with them, all are manufactured of a thermoplastic material with allowable compressive stress [σ] of 55-100 MPa. Surface of stems 19, 20 of the valves 15, 16 contacting with the shaped surface of the rotary element 22 is extended in the form of a portion of a second-order curve (described by equation $R=\sqrt{x^2+y^2+z^2}$), for instance, in the form of a portion of spherical, elliptical or parabolic surface.

Rotary element 22 and stems 19 and 20 of the valves 15 and 16 (or upper portion of said stems 19 and 20) can be manufactured of polyamide or polyacetal. Rotary element 22 with shaped surface 21 is arranged in the form of a ring located around upper cylindrical portion of the flow switch 2 body, and shaped surface 21 is located on the side of the rotary element 22, which is in contact with stems 19, 20 of the valves 15, 16. Flow switch 2 and rotary element 22 are closed by lid 24 from above.

Unit 4 for securing plastic bottle 5 neck to the open end 6 of the drainage channel 3 comprises an annular elastic element 25 attached to the end of the drainage channel 3 coaxially to its outlet opening, a cup 26 with control handle 27, and a socket 28 matching the size of the plastic bottle 5 neck. Cylindrical portion of the cup 26 is located around the open end of the drainage channel 3 and kinematically connected with housing 1 wall by means of a bayonet joint. A foam suppression unit 29 comprises a tap 30 with a through axial passage 31. Tap 30 has an outer cylindrical portion with a spiral groove 32 on the lateral surface. A shank of the tap 30 forms an annual cavity 33 between outer surface of the shank and the surface of the expanded end portion of the drainage channel 3. Diameter of the cylindrical portion of the tap 30 corresponds to the diameter of the end portion of the drainage channel 3. Annular cavity 33 of the drainage channel 3 is connected to the spiral groove 32, and axial channel 31 of the nozzle 30 is connected to control valve 11 by means of channel 12. CO2 gas pressure relief is accomplished with a fitting 34 connected by channel 35 to channel 12 of the control valve 11.

The beverage dispensing device includes unit 36 for connecting valve for dispensing beverage into small container (a glass or a mug). Rotary element 22 with shaped surface 21 comprises a mechanism for resetting rotary element 22 and bringing valves 15 and 16 into closed position. Rotary element 22 reset mechanism can be arranged, for example, in the form of a torsion spring 37. The ends of the torsion spring 37 are fixed respectively on the rotary element 22 and on the rotary element 22 pivot axle (at the upper cylindrical portion of the flow switch 2).

Rotary element 22 is provided with a lock for fixing it in positions: in initial position; with opened gas supply valve 16; with opened beverage supply valve 15. This lock is arranged in the form of an element 39 (a ball, a cylinder, or a cone) spring-loaded by the spring 38. Element 39 of the lock is located in the body of the flow switch 2, with possibility of being positioned in one of the three slots 40, arranged on the pivot axle of the rotary element 22 or its shaped surface 21.

Device for manually dispensing of foaming and carbonated beverages operates in the following way. The device for counterpressure filling plastic bottles 5 (see FIGS. 2 and 3) is supposed to be installed, for example, on the bar counter, and fittings 9 and 10 are to be connected to the beverage supply tube from isobaric container and gas supply tube from a gas bottle, correspondingly. The device for manually pouring foaming and carbonated beverages according to the present invention can be used for filling with a beverage a mug (or a glass) by means of a valve (not shown) connected to unit 36 (see FIG. 3). The device under consideration also allows for filling plastic bottles 5 (see FIGS. 1-5). To do it, plastic bottle 5 is to be inserted into socket 28 of cup 26 of the unit 4, and by turning the handle 27 to be tightly connected to the open end of the drainage channel 3 by virtue of the elastic annular element 25. At this time control valve 11 is closed. Valves 15 and 16 of the flow switch 2 are set in closed position (control handle 23 is located in its neutral position opposite to the control valve 11). Then control handle 23 together with rotary element 22 of the flow switch 2 is to be turned by 45° counterclockwise, see FIG. 4) to open valve 16 and communicate cavity 14 with gas $CO_2$ by channel 8, drainage channel 3, annular cavity 33 of the drainage channel 3, and spiral groove 32 to the internal volume of the plastic bottle 5. Upon that the $CO_2$ gas under pressure from isobaric container enters the plastic bottle 5, the pressure in which rises up to the isobaric container pressure level. After that the control handle 23 together with rotary element 22 is to be turned by 105° in the opposite direction (clockwise) to communicate beverage fitting 9 through the cavity 13, channel 7 and drainage channel 3, annular cavity 33 of the drainage channel 3, and spiral groove 32 to the internal volume of the plastic bottle 5. Since pressure in the consumer plastic container equals the pressure in the isobaric container, beverage does not enter the said container 5. At opening of the control valve 11 gas $CO_2$ through axial channel 31 and aperture of the control valve 11 is displaced from the plastic container 5 to atmosphere. It creates a pressure drop in the isobaric container and plastic container 5, whereby the beverage fills container 5. Passing through the spiral groove 32 of the cylindrical portion of the nozzle 30, the beverage under action of centrifugal forces in the form of a taper-shaped film flows onto the walls of the neck of plastic container 5, and then smoothly flows down by the walls, owing to which foaming is prevented. Besides, foam suppression is achieved by creating gas pressure in the dispensing system and above the beverage level in the plastic container 5, which exceeds the saturation pressure of the gas dissolved in the beverage. After filling the plastic container 5 to stop beverage inflow it is necessary to turn handle 23 together with rotary element 22 by an angle of 60 degrees (counterclockwise) to its initial position. The remainder of the gas in the neck of the bottle is removed through the axial channel 31 of the nozzle 30 and the aperture of the control valve 11 to atmosphere. Pressure in the plastic container 5 filled with beverage levels up to atmospheric pressure. After that, the handle 27 is to be rotated in the opposite direction to disconnect the open end of the drainage channel 3 from the neck of the plastic container 5. Container 5 is taken out of the device, plugged-up and conveyed to the consumer.

It follows from the description of the present application, that the claimed invention provides for the above-mentioned technical result, i.e. increases the durability, reliability and maintainability of the flow switch of the apparatus for manually dispensing of beverages.

The invention claimed is:

1. An apparatus for dispensing foaming and carbonated beverages comprising:

(a) a drainage channel comprising a first open end and a second open end;

(b) a flow switch comprising (i) a first port for receiving a gas feed; (ii) a second port for receiving a beverage feed; (iii) a first channel for channeling the gas feed received in the first port through a cavity in the first channel to and through the first open end of the drainage channel; (iv) a second channel for channeling the beverage feed received in the second port through a cavity in the second channel to and through the first open end of the drainage channel; (v) a first valve comprising a first stem, a first biasing element that biases the valve to an open position and a first blocking portion that blocks a flow of gas through the cavity in the first channel when the first valve is displaced from the open position to a closed position, the first blocking portion being disposed in the first cavity, the first biasing member and a top portion of the first stem being disposed outside of the first cavity; and (vi) a second valve comprising a second stem, a second biasing element biasing the second valve to an open position and a second blocking portion that blocks the feed of gas through the cavity in the second channel when the second valve is displaced from the open position to a closed position, the second blocking portion being disposed in the second cavity, the second biasing member and a top portion of the second stem being disposed outside of the second cavity;

(c) a rotating element that is rotatable between a first position, a second position and a third position, the rotating element comprising a surface kinematically connected to the respective top portions of the first and second stems and being shaped such that (i) with the rotating element rotated to the first position, the shaped surface biases the first valve from its open position to its closed position to block the flow of gas through the first cavity to the drainage channel, (ii) with the rotating element rotated to the second position, the shaped surface biases the second valve from its open position to its closed position to block the flow of beverage through the first cavity to the drainage channel, and (iii) with the rotating element rotated to the third position, the shaped surface biases both the first valve and the second valve from their respective open positions to their respective closed positions to block the respective flows of beverage and gas to the drainage channel;

(d) a control handle disposed outside of the first and second cavities and rigidly connected to the rotary element for rotating the rotary element between the first, second and third positions;

(e) a housing comprising the flow switch; and (f) means for securing the housing to a neck of a plastic bottle with the second open end of the drainage channel disposed in the bottle such that, with the apparatus secured to the neck of the plastic bottle (i) gas channeled through the first channel to and through the first open end of the drainage channel can pass through the drainage channel and into the bottle through the second open end of the drainage channel and (ii) beverage channeled through the second channel to and through the first open end of the drainage channel can pass through the drainage channel and into the bottle through the second open end of the drainage channel.

2. The apparatus according to claim 1, comprising a first tube for transporting gas from a gas feed to the first port and a second tube for transporting beverage from a beverage feed to the second port.

3. The apparatus according to claim 1, wherein the respective stems of each of the first and second valves are disposed transverse to portions of the respective first and second channels that are disposed between the first cavity and the first open end of the drainage channel and the second cavity and the first open end of the drainage channel respectively.

4. The apparatus according to claim 3, wherein each of the first and second cavities is axially symmetric.

5. The apparatus according to claim 1, wherein the flow switch is removable from the housing.

6. The apparatus according to claim 1, wherein the rotary element is made of a thermoplastic material with an allowable compressive stress of 55-100 MPa.

7. The apparatus according to claim 6, wherein respective surfaces of the first and second stems which come into contact with the shaped surface of the rotary element have a curvature that is shaped as a portion of a second order curve.

8. The apparatus according to claim 7, wherein the curvature of the respective surfaces of the first and second stems is shaped as a portion of a sphere, ellipse or parabola.

9. The apparatus according to claim 1, wherein each of the rotary element and the first and second stems comprises polyamide or polyacetal.

10. The apparatus according to claim 1, further comprising means disposed in the housing for allowing gas that has built up in the bottle to be released from the bottle so that pressure within the bottle can be controlled.

11. The apparatus according to claim 10, wherein the means for allowing gas release from the bottle comprises a control valve and a gas-release channel having a first end opening into the bottle when the means for securing secures the housing to the neck of the bottle, and wherein the gas-release channel is disposed to channel gas from the bottle to ambient atmosphere via the control valve when the control valve is open.

12. The apparatus according to claim 1, wherein the drainage cavity comprises means for suppressing foam in a beverage that is channeled through the second channel and passes through the drainage channel and into the bottle through the second open end of the drainage channel.

13. The apparatus according to claim 12, wherein the means for suppressing foam comprises a cylindrical nozzle having an axial channel with a spiral groove at the second open end of the drainage channel.

14. The apparatus according to claim 1, wherein each of the first and second biasing elements is a spring.

15. The apparatus according to claim 1, wherein the rotary element comprises means for re-setting the rotary element by biasing the first and second valves to their closed positions.

16. The apparatus according to claim 15, wherein the means for re-setting comprises a torsion spring having a first end fixed to the rotary element and a second end fixed to a pivot axle for the rotary element.

17. The apparatus according to claim 16, comprising means for locking the rotary element in an initial position.

18. The apparatus according to claim 17, wherein the means for locking comprises (i) a spring-loaded element disposed in the flow switch and (ii) three slots disposed in the pivot axle or shape surface, and wherein the spring-loaded element is positionable in any one of the three slots.

* * * * *